US005494201A

United States Patent [19]

Szadkowski

[11] Patent Number: 5,494,201

[45] Date of Patent: Feb. 27, 1996

[54] DEVICE FOR INSERTING A RETRACTABLE BLANK SHUTTING OFF PLATE IN A DEVICE FOR THE CONVEYANCE AND EXCHANGE OF A POURING TUBE

[75] Inventor: Stanislav Szadkowski, Marly, Switzerland

[73] Assignee: International Industrial Engineering S.A., Braine-l'alleud, Belgium

[21] Appl. No.: 377,206

[22] Filed: Jan. 24, 1995

[51] Int. Cl.[6] ..... B22D 41/08

[52] U.S. Cl. ..... 222/600; 266/DIG. 1; 222/606

[58] Field of Search ..... 266/236, DIG. 1; 222/606, 607, 600

[56] References Cited

U.S. PATENT DOCUMENTS 4,220,271 9/1980 Szadkowski ..... 222/607

4,693,401 9/1987 Nishimura et al. ..... 222/607

5,188,743 2/1993 King ..... 222/600

*Primary Examiner*—Scott Kastler

*Attorney, Agent, or Firm*—Abelman, Frayne & Schwab

[57] ABSTRACT

An emergency blank shutting off device for conveying and exchanging pouring tubes sliding along guide-rails (6,7) determining a first trajectory is intended to ensure the immediate and tight stop of a casting operation in case of emergency. It comprises a carrier on which an emergency blank re-fractory plate (8) is set and actuated along a second trajectory which crosses over the first trajectory, from a readiness position (14), off the second trajectory to an alert position (15) on a zone overlapping the two trajectories adjacent to the operating position of a pouring tube (3) in the pouring axis.

7 Claims, 5 Drawing Sheets

DEVICE FOR INSERTING A RETRACTABLE BLANK SHUTTING OFF PLATE IN A DEVICE FOR THE CONVEYANCE AND EXCHANGE OF A POURING TUBE

BACKGROUND OF THE INVENTION

1. Field of the invention

The present invention relates to an emergency blank shutting off plate for a device for conveying and exchanging pouring tubes tightly applied against the lower fixed face of a reference refractory plate or against the mobile face of a slide-plate at the bottom and of a metal pouring vessel, while being pressed upwards against guide-rails who determine a rectilinear trajectory along which slide the aforesaid pouring tubes; the aforesaid blank plate is actuated by a jack, from the loading position to an operating position in the pouring axis direction and from the operating system towards a retracted position.

The invention is mainly applied in the steel industry for continuous casting installations, in order to ensure the immediate and tight stop of a casting operation in case of emergency.

2. Description of the Prior Art

Thanks to document W092/00822, knowledge is already available as regards a device for conveying and exchanging interchangeable tubes for a vessel pouring metal from its the bottom end in which a retractable blank plane or an attached plate for a replacement tube and that of a replacement are arranged to slide on guide rails which are able to transmit an upward pushing force and to guide the traversing displacement of the plates and of the pouring tubes in parallel with their own axis, this by actuation of a jack, from a loading position to an operational position while following the pouring axis, and from the operational position to a retractable position. The replacement pouring tube attached to a plate bears by a common transverse edge against the plate which carries a pouring tube which has to be re-placed or against a blank shutting off plate and removes the latter from the pouring orifice in order for the exchange of tubes to occur without lifting the vessel.

When considering the possibility of a technical or technological incident, it is imperative that means should be immediately available for urgently shut-ting off the pouring operation. For this purpose, it was foreseen for known conveyance and exchange devices, during the pouring operation, a blank refractory plate that was in readiness and juxtaposed by a common transverse edge against a plate carrying the pouring tube in the operating position along the pouring axis. A few moments prior to replacing the worn tube by a replacement tube, the blank plate was removed and the aforesaid replacement tube was than set in position.

However, retracting the blank plate was a somewhat complicated operation because of the extremely high temperatures prevailing around the pouring axis and of the risk of forgotting to put it again in its place or to lose it in the ingot mould by a wrong move of the operator during his preparation work for loading the replacement tube.

SUMMARY OF THE INVENTION

The object of the present invention is to facilitate positioning and retracting the refractory blank plate during or after the conveyance and exchange operation of a pouring tube in a continuous casting installation. For this purpose it proposes an emergency shutting off device of the type described in the preamble of claim 1 enclosed. This shutting off device is characterized in that it comprises a plate on which is set a blank refractory plate for the purpose of travelling along a second trajectory which cuts across the first aforesaid trajectory, from a readiness position outside the second trajectory to a position of alert in a zone overlapping the two trajectories, adjacent to the operating position of the pouring tube in the pouring axis.

A feature of the invention is that the aforementioned trajectories are parallel to the inside fixed face of the reference plate and lie in the same horizontal plane.

This technical result is achieved when the bearing surfaces of the mobile plate and of the guide rails are in the same horizontal plane.

In a particular type of embodiment, the mobile plate is a plate which rotates by means of a rotating arm hinge-jointed around a vertical axis to a structure of the conveying and exchange device of the pouring tubes.

In a second particular type of embodiment, the mobile plate is a drawer shaped plate sliding along rectilinear guides fixed to the structure parallel to the reference refractory plate.

In a development of the invention, the mobile plate is fitted with a handle and/or a puller or a sleeve of easier access for the operator than the actual mobile plate, for manual operation of the aforesaid mobile plate.

These features and details of the invention as well as others will appear in the detailed description of a preferred embodiment of the invention illustrated on the enclosed drawings.

DESCRIPTION OF THE PREFERRED EMBODIMENTS

Figure 1:
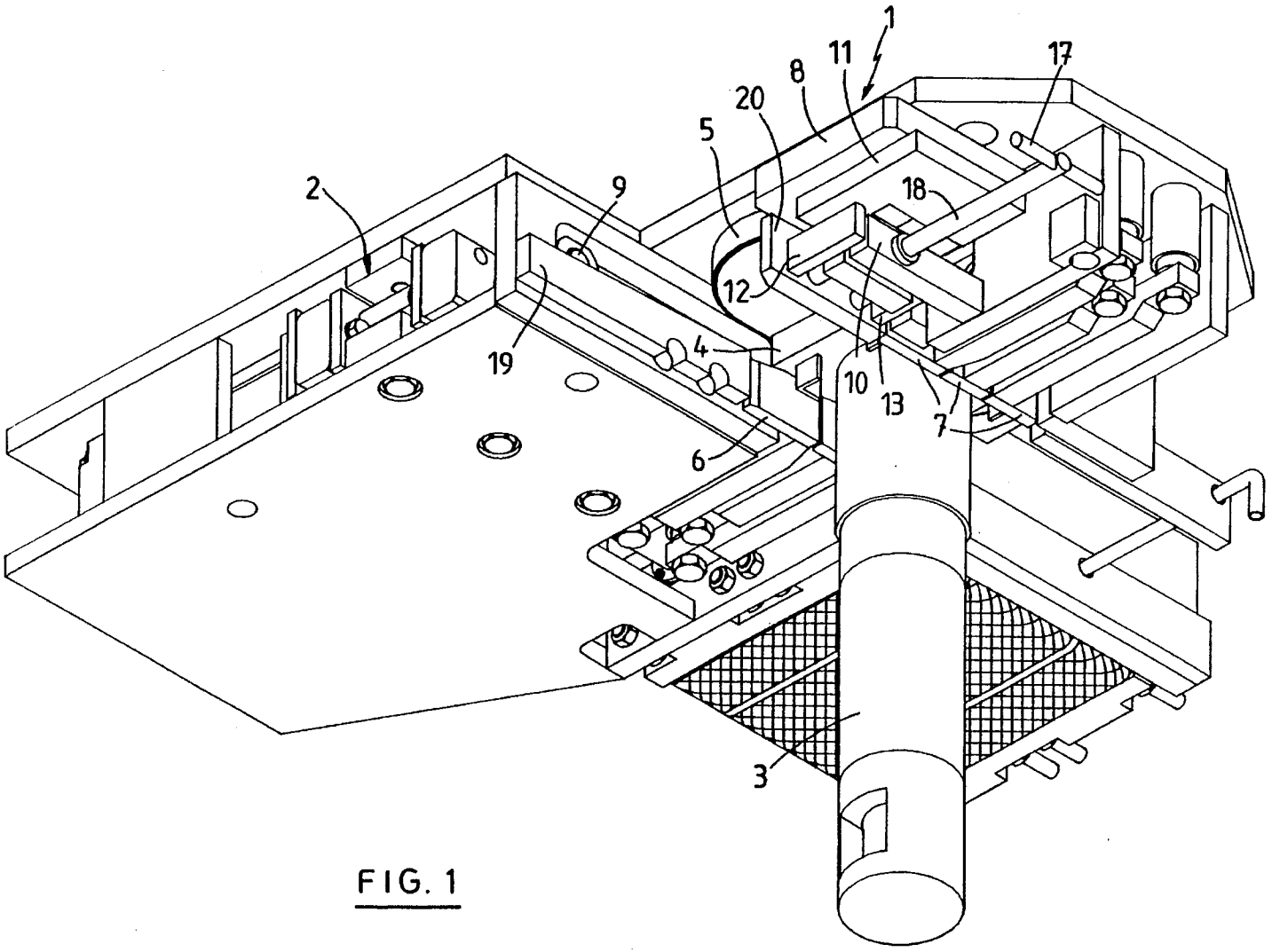
FIG. 1 is a perspective view of a device for the conveyance and exchange of pouring tubes fitted with an emergency sliding blank plate shutting off device, in the retracted position.
Figure 2:
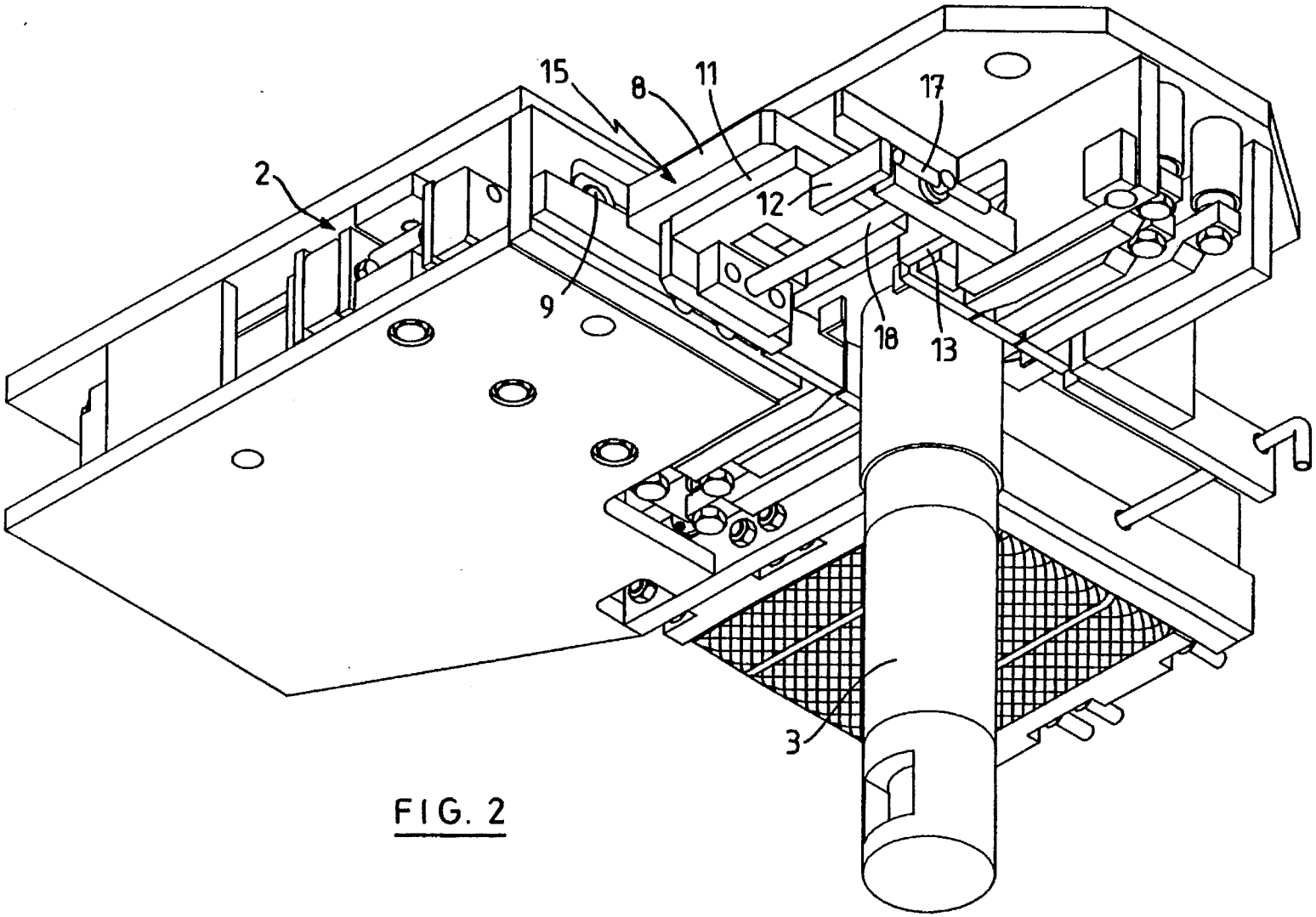
FIG. 2 is a view similar to that of FIG. 1, of the emergency blank plate shutting off device, in the alert position.
Figure 3:
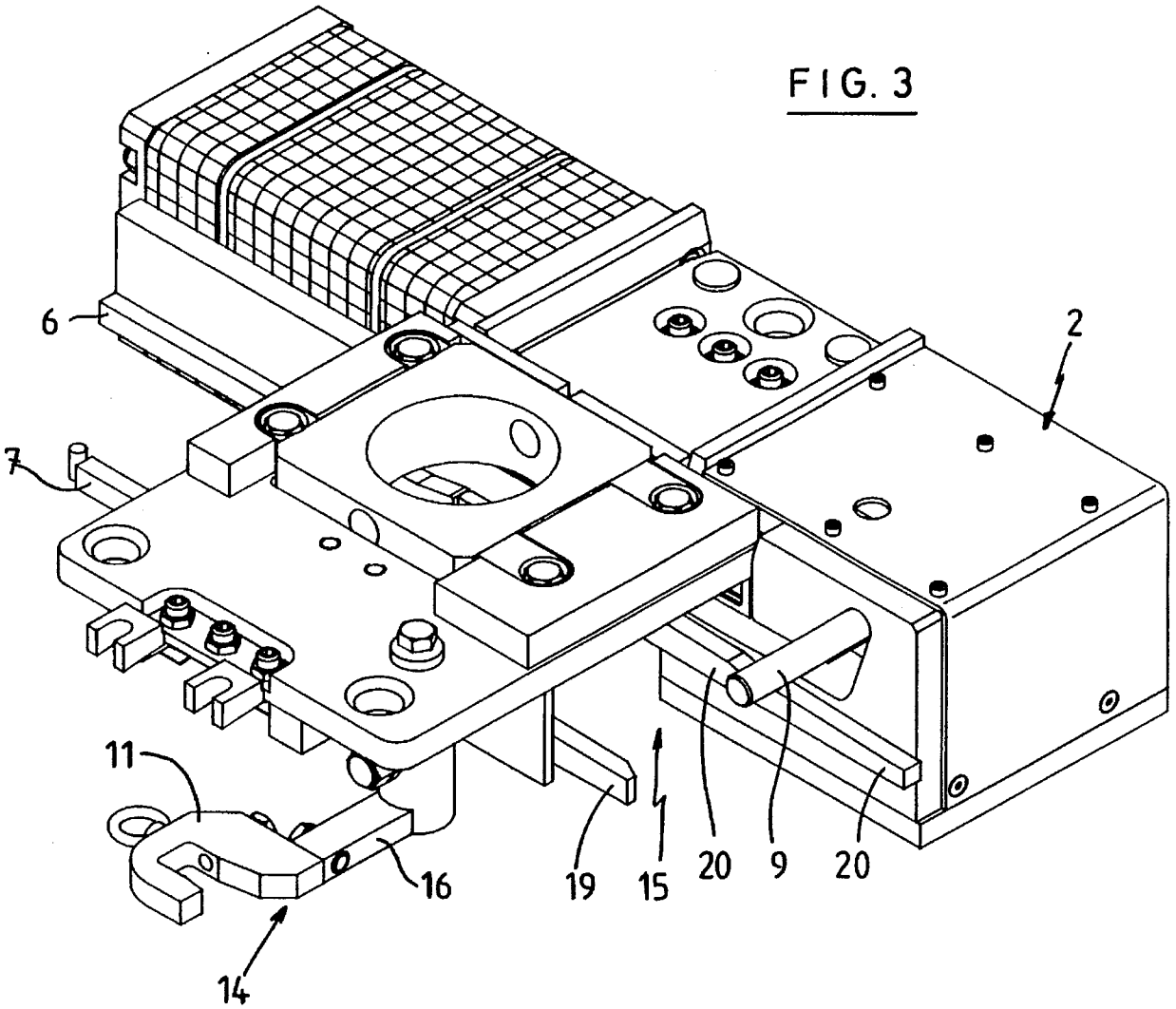
FIG. 3 is a perspective view of a rotating plate ready to carry a refractory blank plate.
Figure 4:
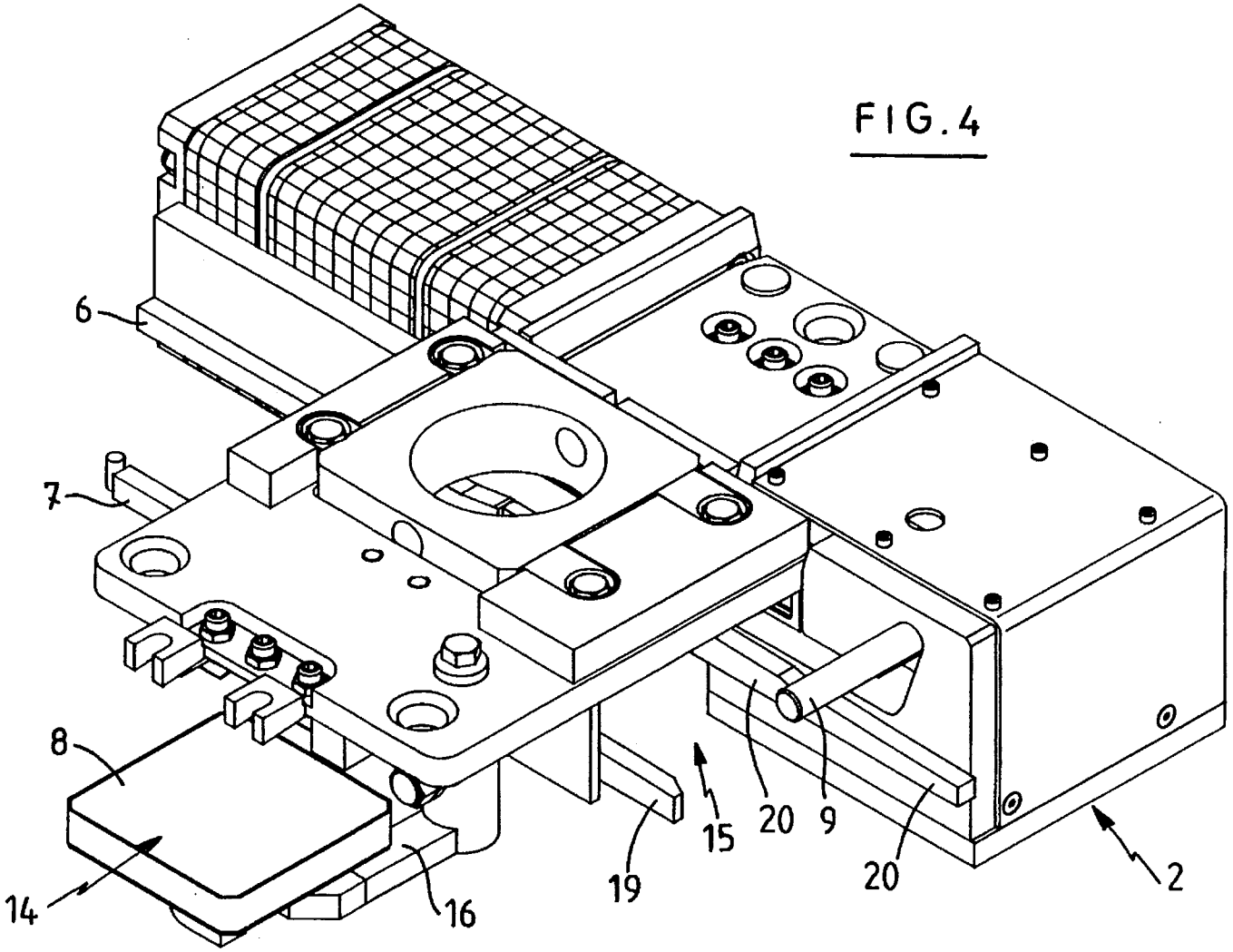
FIG. 4 is a view similar to that of FIG. 3, of a rotating plate in the retracted position on which is set a refractory blank plate.
Figure 5:
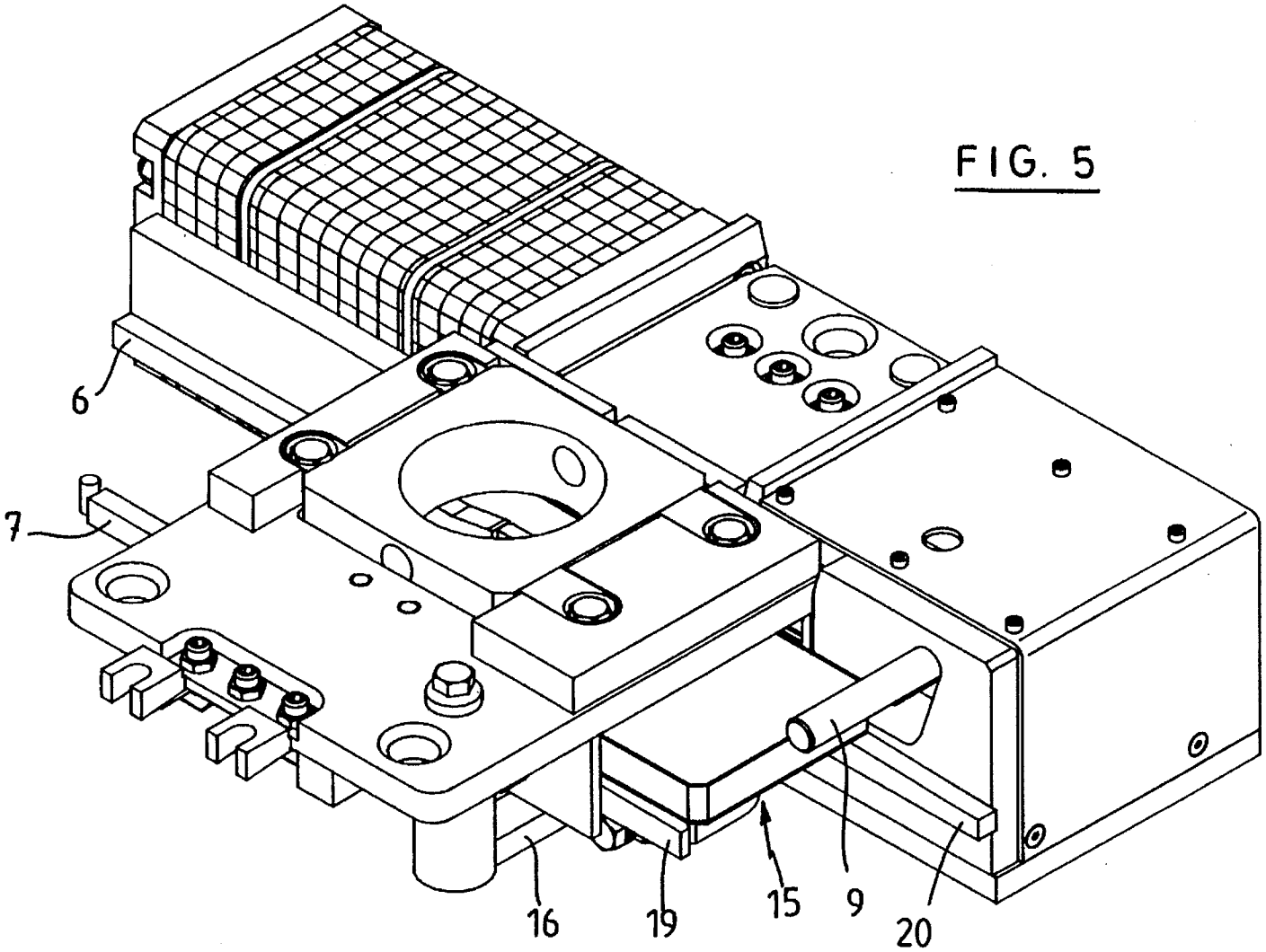
FIG. 5 is a view similar to FIGS. 3 and 4 of the rotating plate in the alert position.

Under a pouring vessel 1, a device 2 for the conveyance and exchange of pouring tubes has been illustrated without however illustrating the ingot mould inside which should be immersed the only pouring tube 3 represented in the operating position along the pouring axis. This tube 3 is fixed to a plate 4 tightly applied against the lower fixed face of a reference refractory plate 5 urged against the frame of the device 2. An upward force is applied on the plate 4 by the guide rails 6 and 7. The stationary guides 19 and 20 determine a first trajectory of the replacement tube and the tube to be replaced.

As soon as a used tube has been replaced by a replacement tube, it will be imperative to set up in the readiness position a blank refractory plate 8 alongside the pouring tube 3, in the operating position in the pouring axis. In case of emergency, the blank shuttling off plate 8 is in readiness for instant travel thanks to the pushing force of the retractable arm 9 of a pneumatic jack, as described in patent EP-B-0192019, in the pouring axis, for replacing the pouring tube which the aforesaid arm had itself pushed back by bearing on a common transverse edge.

A complete shutting off device 10 incorporated to the structure of the conveyance and exchange device for pouring tubes in the close vicinity of guide rails 6, 7 is able to insert or retract as long as necessary the blank refractory plate 8 from an alert position 15 next to the operational position and vice versa. The blank plate shutting off device 10 comprises a mobile plate 11 which carries the blank refractory plate 8. The mobile plate 11 displaces the blank refractory plate 8 along a second trajectory which cuts across the aforesaid first trajectory, from a readiness position 14 outside the second trajectory to a position of alert 15 in a zone overlapping the two trajectories adjacent to the operational position of a pouring tube in the pouring axis.

In a first type of embodiment illustrated by FIG. 1, the mobile plate 11 is a drawer shaped plate sliding on the rectilinear guides 12, 13 fixed to the structure of the conveyance and exchange device of the pouring tubes. The mobile plate is fitted with a handle 17 and a puller or sleeve 18 of easier accessible to the operator than the mobile plate 11 as such, for its manual operation.

In a second type of embodiment the mobile plate 11 is a plate which rotates by means of a rotating arm 16 hinge—jointed around a vertical axis to the structure of the conveyance and exchange device of the pouring tubes.

The advantages due to the blank plate shutting off device described hereabove are the following.

- the setting up and retracting of the shutting off refractory plate is reliable, convenient and simple;
- it is handled at a distance;
- it avoids the operator being hindered when he changes over to a replacement tube which is pre-heated, red-hot; and
- it does not risk to be lost because it remains completely attached to the conveyance and exchange device of the pouring tube.

I claim:

1. Emergency blank plate shutting off device for a conveyance and exchange device of pouring tubes (3) having a movable upper plate tightly pressed against a lower fixed face of a fixed reference refractory plate (5) fixedly mounted at a bottom wall of a bottom pour vessel (1) or of a mobile plate of sliding gate of said bottom pour vessel (1), under the effect of an upward thrust transmitted by guide-rails (6,7) which determine a first rectilinear trajectory along which slides each of the plates (4) of said pouring tubes, actuated by a jack (10), from a loading position to an operating position in the axis of pouring, and from the operating position to a retracting position, wherein a carrier on which is set an emergency blank refractory plate (8) shutting off device moves said blank plate (8) along a second trajectory, which crosses over said first trajectory, from a readiness position (14), off the second trajectory to an alert position (15) on a zone overlapping the two trajectories adjacent to the operating position of a pouring tube (3) in the pouring axis.

2. Device according to claim 1, wherein the aforesaid trajectories are parallel to the fixed bottom face of the reference plate (5) and set in the same horizontal plane.

3. Device according to claim 1, wherein the plate (4) and the guide rails (6, 7) have bearing surfaces in the same horizontal plane.

4. Device according to claim 1, wherein the mobile plate (11) is a plate which rotates by means of a rotating arm (16) hinge-jointed around a vertical axis to the structure of a device for the conveyance and exchange of pouring tubes.

5. Device according to claim 1, wherein the mobile plate (11) is a sliding gate on rectilinear guide-rails (12,13) fixed to the structure.

6. Device according to claim 1, wherein the mobile plate (11 ) is fitted with a handle (17) and a pusher or sleeve (18) of easier access to an operator than the mobile plate (11) as such for its manual operation.

7. Device according to claim 1, wherein the mobile plate (11) is driven by a remote controlled jack.

* * * * *